US007333004B2

(12) United States Patent
Ha et al.

(10) Patent No.: US 7,333,004 B2
(45) Date of Patent: Feb. 19, 2008

(54) SELF-ADJUSTING STROBE

(75) Inventors: Simon Ha, Aurora, IL (US); Robert Asinjo, Lisle, IL (US)

(73) Assignee: Honeywell International, Inc., Morristown, NJ (US)

( * ) Notice: Subject to any disclaimer, the term of this patent is extended or adjusted under 35 U.S.C. 154(b) by 297 days.

(21) Appl. No.: 10/931,630

(22) Filed: Sep. 1, 2004

(65) Prior Publication Data

US 2006/0044150 A1 Mar. 2, 2006

(51) Int. Cl.
*G08B 5/00* (2006.01)
*H05B 39/00* (2006.01)
*H05B 41/00* (2006.01)

(52) U.S. Cl. ..... 340/331; 340/815.73; 315/241 P

(58) Field of Classification Search ..... 340/331, 340/815.73, 815.74; 315/241 P–241 S
See application file for complete search history.

(56) References Cited

U.S. PATENT DOCUMENTS

| | | | | |
|---|---|---|---|---|
| 5,189,344 | A * | 2/1993 | Rose | 315/293 |
| 5,645,578 | A * | 7/1997 | Daffer et al. | 607/91 |
| 5,931,569 | A | 8/1999 | Anderson | 362/346 |
| 6,271,634 | B1 * | 8/2001 | Saiger | 315/241 S |
| 6,488,390 | B1 * | 12/2002 | Lebens et al. | 362/231 |
| 6,522,261 | B2 * | 2/2003 | Scheffler et al. | 340/815.73 |
| 6,623,143 | B2 | 9/2003 | Anderson | 362/297 |
| 2004/0077264 | A1 * | 4/2004 | Walker et al. | 446/175 |
| 2005/0248291 | A1 * | 11/2005 | Logsdon et al. | 315/241 R |
| 2007/0133199 | A1 * | 6/2007 | Lebens et al. | 362/157 |

* cited by examiner

*Primary Examiner*—Benjamin C. Lee
*Assistant Examiner*—Travis R. Hunnings
(74) *Attorney, Agent, or Firm*—Welsh & Katz, Ltd.

(57) ABSTRACT

A strobe unit responds to a selected candela output by selecting an optimal capacitor charging frequency to minimize current requirements at the selected candela output. A plurality of charging frequencies can be stored and associated with available input power and selected candela output.

18 Claims, 6 Drawing Sheets

OPTIMUM FREQUENCY AT SPECIFIC VOLTAGES

SELF-ADJUSTING STROBE

FIELD OF THE INVENTION

The invention pertains to strobe units that provide visible alarm indications. More particularly, the invention pertains to such units which alter internal operating parameters in response to externally related conditions.

BACKGROUND OF THE INVENTION

It has been know to use strobe units to provide pulses of visible light, as indicators of an alarm condition, in fire alarm systems and the like. One such strobe has been disclosed in Ha et al. U.S. patent application entitled "Processor Based Strobe with Feedback" application Ser. No. 10/444,227 filed May 23, 2003 and assigned to the Assignee hereof. The disclosure and figures of the '227 application are hereby incorporated herein by reference. U.S. Pat. No. 6,522,261 B2 entitled "Selectable Candela Strobe Unit" which issued Feb. 18, 2003 is assigned to the assignee hereof and is incorporated herein by reference. The '261 patent discloses strobes having variable candela output levels.

Such units, as noted above, while useful require electrical energy to operate. Where numerous strobes are present in an alarm system current demands by such strobes which are often coupled to relatively long power supply lines can cause losses, generate heat, and require supplemental power supplies.

There is thus a continuing need to address strobe unit current demands. It would be desirable to do so transparently from an installer's perspective for different light output settings.

DETAILED DESCRIPTION OF THE EMBODIMENTS

Figure 1:
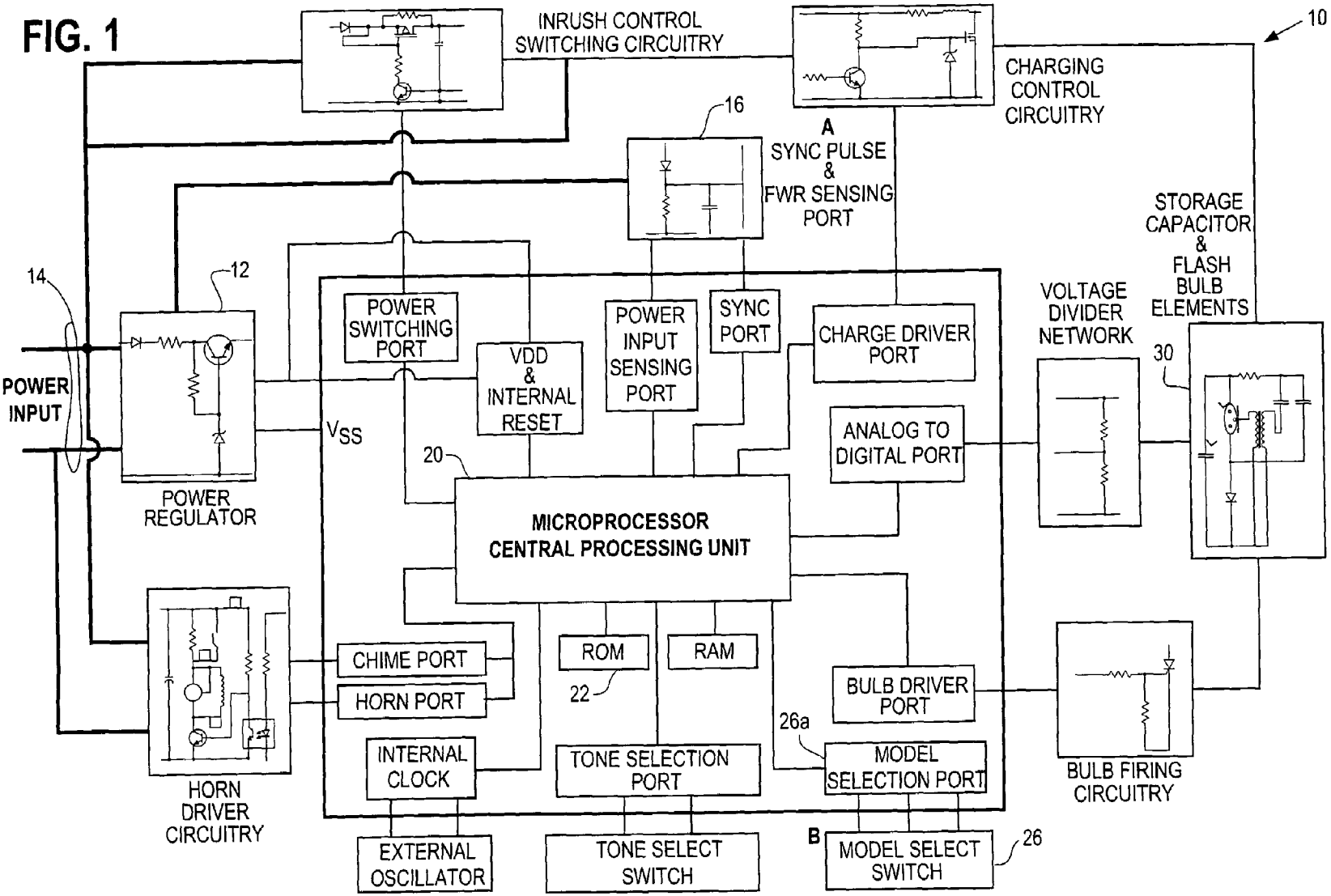
FIG. 1 is a block diagram of a strobe in accordance with the invention.

While embodiments of this invention can take many different forms, specific embodiments thereof are shown in the drawings and will be described herein in detail with the understanding that the present disclosure is to be considered as an exemplification of the principles of the invention and is not intended to limit the invention to the specific embodiment illustrated.

FIG. 1 illustrates a strobe unit 10 which incorporates a power regulator 12 for providing local unit power off of power input lines 14. Applied power from lines 14 could be DC power or could be full wave rectified. Circuitry 16 senses the presence of synchronizing pulses as well as senses the presence of full wave rectified input power.

Strobe unit 10 is controlled in an overall fashion by processor 20. Processor 20 in conjunction with a control program prestored in read only memory (EEPROM for example) 22 can carry out a plurality of functions including sensing selected output candela, via model select switch 26, and establishing whether the input power applied via lines 14 is DC or full wave rectified using circuitry 16. Other functionality of the strobe unit 10 is discussed in further detail in the '227 application incorporated herein by reference.

Processor 20 in combination with the control program from read only memory 22 can establish using a prestored lookup table, the target value to which a storage capacitor, a component of the storage capacitor and flash tube element 30 should be charged to output light in accordance with a candela level selected using a model select switch 26. Such processing was also described in detail in the '227 application incorporated herein by reference. As discussed subsequently, unit 10 operates so as to minimize its current requirements.

Figure 2:
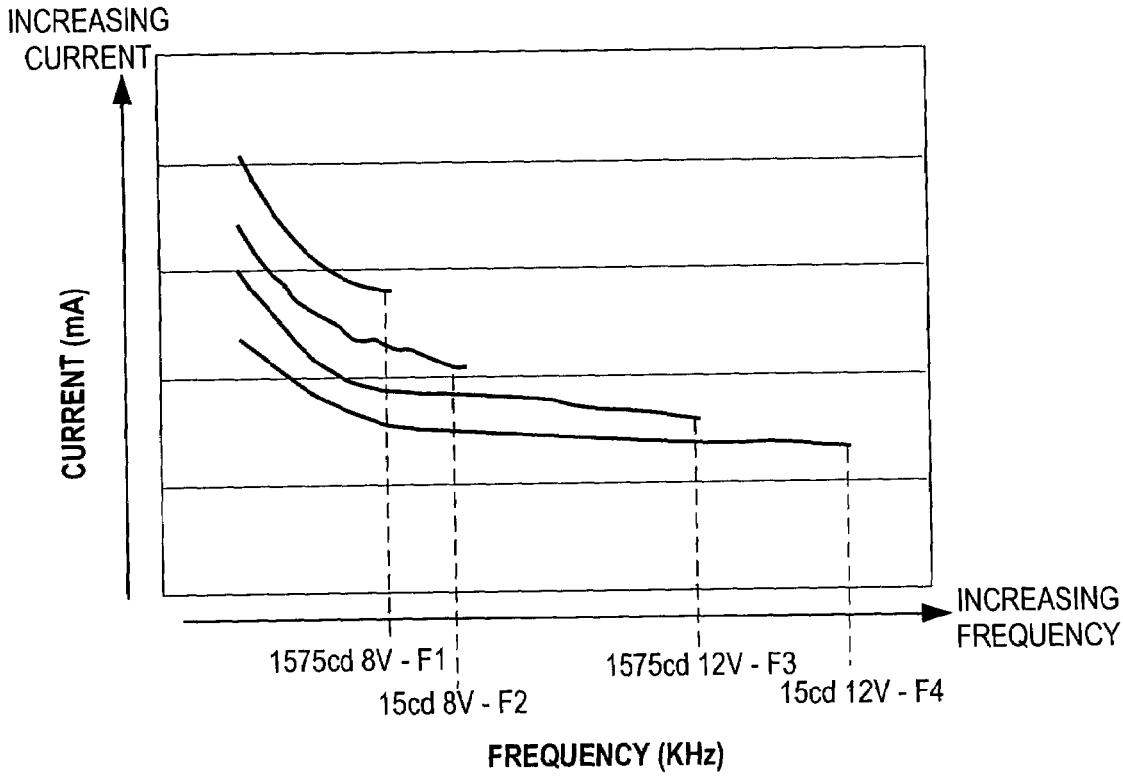
FIG. 2 illustrates a current minimizing graph.

FIG. 2 is a graph where current required to drive a strobe unit, such as the strobe unit 10, is plotted as a function of frequency for various 15 candela units driven with 8 volt or 12 volt inputs. Preferably, a selected strobe unit 10 which is to output 15 candela will be operated at a charging frequency which corresponds to minimal required current for the available input voltage and selected candela output. It will be understood that graphs such as the graph of FIG. 2 could be determined for a variety of different candela outputs such as 30 candela, 75 candela, 110 candela. It will be understood relative to FIG. 2 that the 15/75 candela model is intended to meet a different optical output standard than is the 15 candela model. The 15/75 candela reflector type is disclosed in Anderson U.S. patent application Ser. No. 10/273,413 entitled "Multi Candela Wall Reflector", assigned to the Assignee hereof and incorporated by reference.

As noted above, preferably the strobe unit 10 will be operated at a minimal current condition by selecting an appropriate charging frequency for the storage capacitor and flash tube 30 based on selected candela output and available input voltage.

Figure 3:
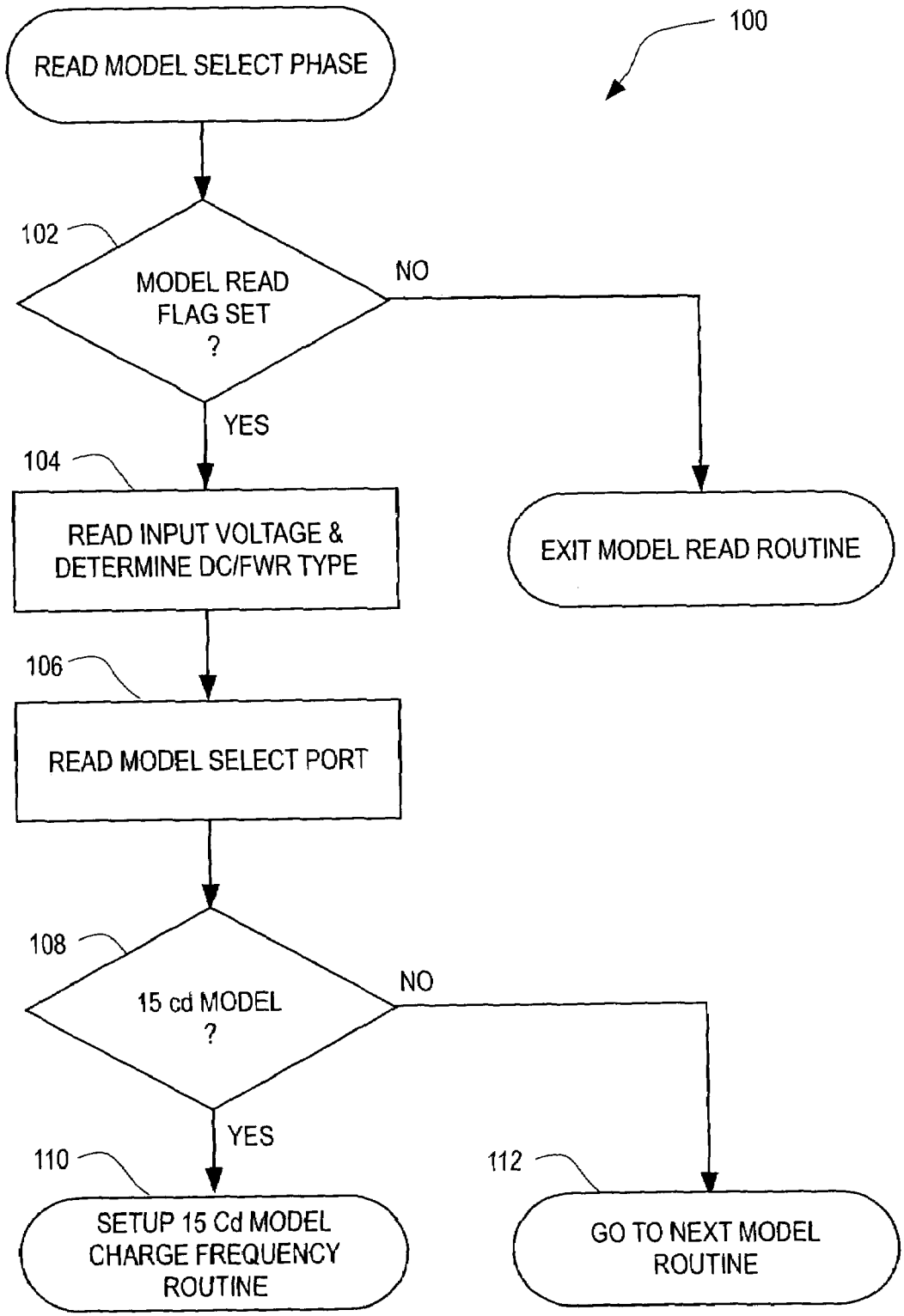
FIGS. 3-5 taken together illustrate a flow diagram of an exemplary method in accordance with the invention.
Figure 4:
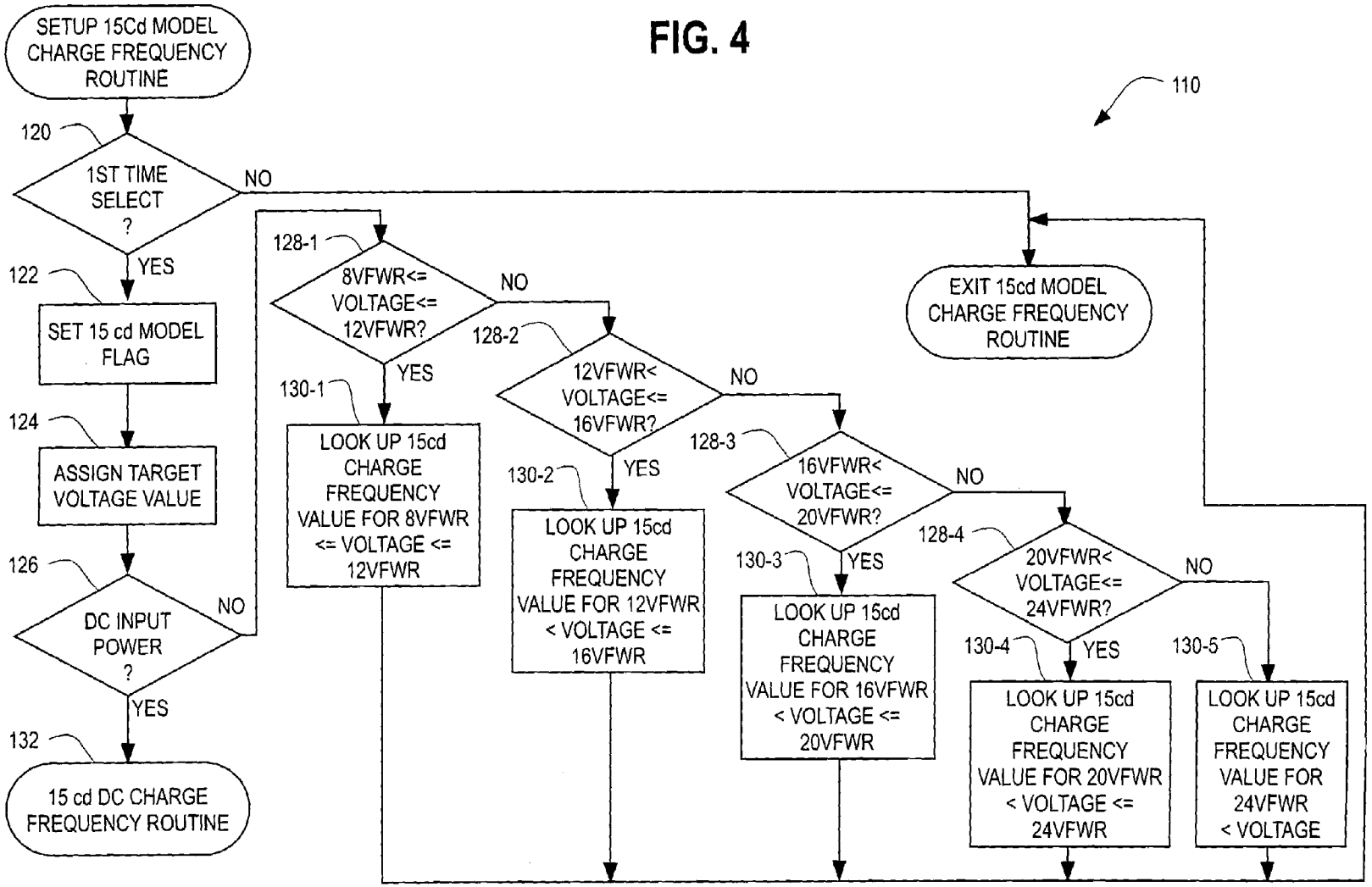
Figure 5:
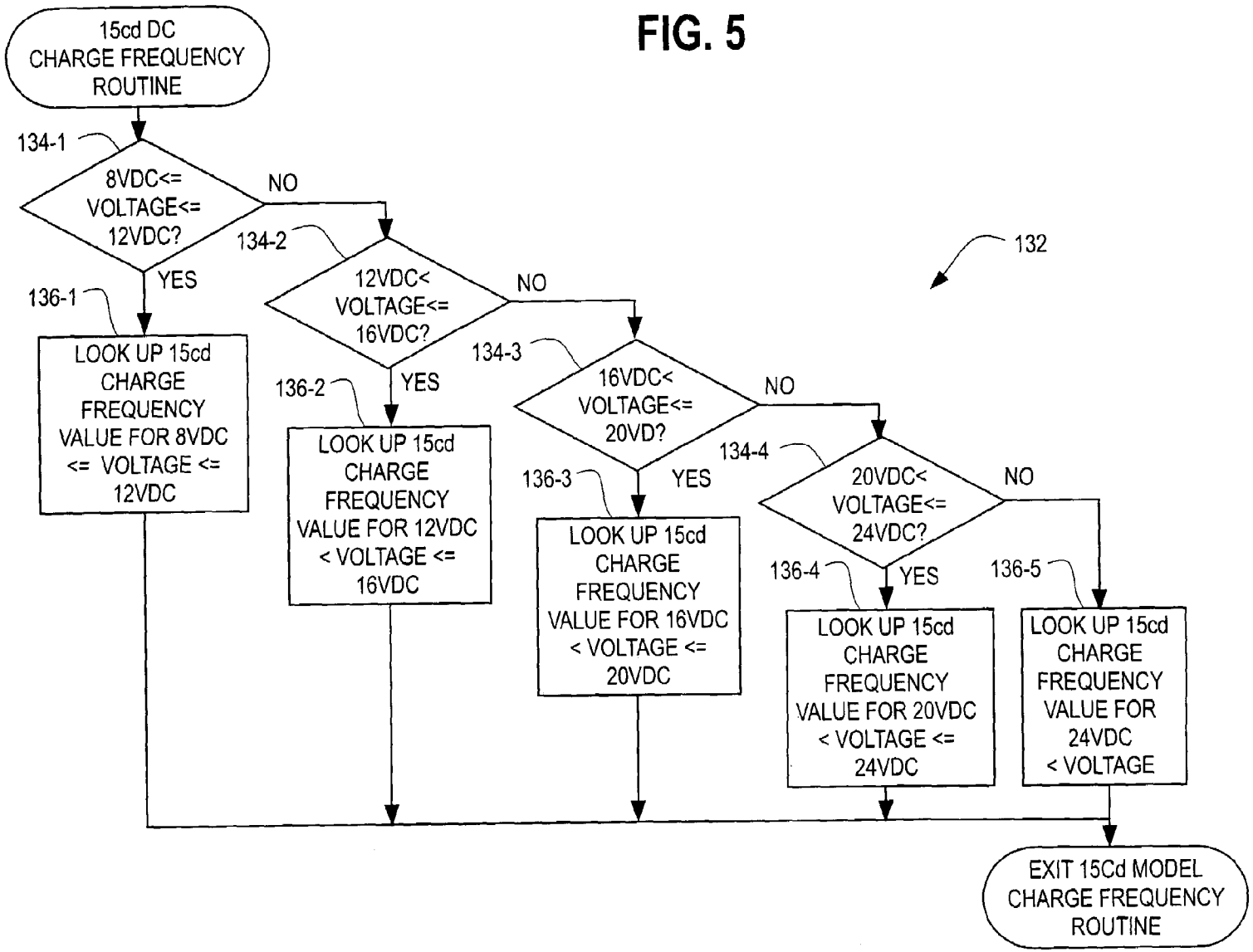

FIGS. 3, 4 and 5, taken together, illustrate a method 100 in accordance with the present invention where the output of strobe 10, using the model select switch 26 has been set to 15 candela. In a step 102 the control program, ROM 22 checks to see if the model read flag has been set. If so, in step 104, the control program senses the input voltage and determines whether DC or full wave rectified power is present on lines 14. The model select port 26*a*, driven by model select switch 26 is sensed in a step 106 to determine the desired candela output. If switch 26 has been set to 15 candela output in step 108, the control program, ROM 22, carries out a 15 candela charge frequency routine, FIGS. 4, 5. In the event that switch 26 has not been set to the 15 candela model position, in step 112, the control circuitry, control program and read only memory 22 switch to methods corresponding to the methods illustrated in FIGS. 4, 5 for the appropriate selected output illumination, such as 30 candela, 75 candela, or 110 candela.

With reference to FIG. 4, the control program ROM 22 checks to see if this is an initial traverse 120, through the steps of FIG. 4. If so, the 15 candela model flag is set, step 122. In accordance with a prestored target voltage table, the 15 candela target voltage value is assigned, step 124.

The control program, read only memory 22, then checks to determine whether DC input power is present on lines 14, step 126. If so, the control program carries out process 132, FIG. 5. Relative to FIG. 5, the input DC voltage is compared to each member of a plurality of DC voltage ranges in steps 134-1, -2, -3, -4. Based on the results of those comparisons, a charging frequency for 15 candela is established based on, for example, a second prestored table which relates ranges of input voltages to selected charging frequencies to minimize current demand per strobe unit, steps 136-1, -2, -3, -4, -5. The selected charging frequency is based on attempting to minimize required current to drive the unit 10. It will be understood that processes such as the process 132 of FIG. 5 could be carried out for each selected light output level, such as 30 candela, 75 candela, 110 candela for various ranges of DC input voltages.

With reference to FIG. 4, in the event that the input power is not DC input power, but rather full wave rectified input power, subsequent to step 126, in a plurality of steps 128-1, -2, -3, -4, the appropriate full wave rectified voltage range is selected by the control program, read only memory 22, and in steps 130-1, -2, -3, -4 and -5, the appropriate charging frequency for the respective full wave rectified range is selected off of yet another prestored table so as to minimize required current draw at the selected 15 candela output level, for the appropriate range of full wave rectified input voltage, lines 14. The selected frequency can then be used to charge the storage capacitor for the flash tube element 30 to the predetermined target voltage value but with a substantially minimized current requirement for the unit 10.

It will be understood that other types of processing could be used to determine optimal charging frequency. For example, fuzzy logic or neural net processing could be used. Instead of pre-stored tables, algorithmic processing could be used. Other types of processing come within the spirit and scope of the invention.

Figure 6:
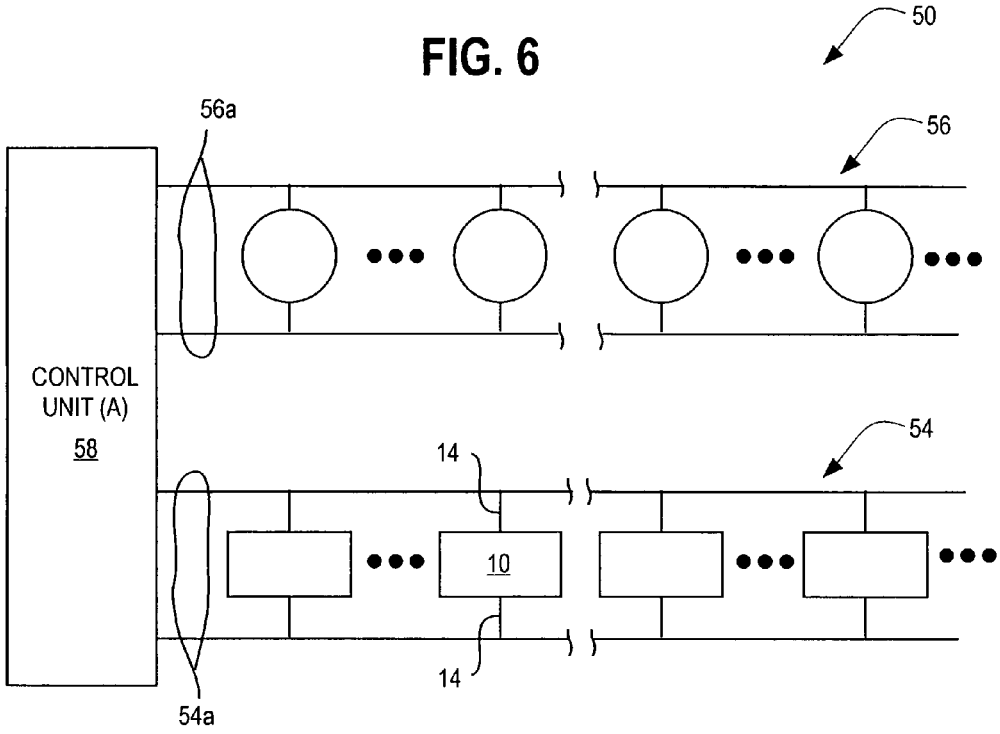
FIG. 6 illustrates a system in accordance with the invention.

FIG. 6 is a block diagram of an alarm system 50 which can incorporate a plurality 54 of current minimizing strobe units, such as the strobe unit 10. The system 50 can also incorporate a plurality 56 of ambient condition detectors as would be understood by those of skill in the art.

The strobe units 54 receive electrical energy, and optionally, control signals via power carrying communication lines 54*a*, which are coupled to one or more alarm system control units 58. The plurality of ambient condition detectors 56 is also in communication with the control units 58 via communication lines 56*a* as would be understood by those of skill in the art.

The plurality of strobe units 54, can include the strobe unit 10 which is in turn coupled to the power supply lines 54*a* via the lines 14. As discussed above, where the strobe units 54 correspond substantially to the strobe unit 10, the plurality 54 operates with minimal required current, on a per strobe unit basis, as discussed above. This is particularly advantageous in that the plurality 54 might contain a large number of units which could potentially draw large amounts of power during an alarm condition. By minimizing the required current, on a per strobe unit basis as discussed above, the plurality 54 can incorporate a larger number of members for the same total current draw than might be the case for a plurality of prior art strobe units which do not carry out the current minimizing processes of the present invention.

Alternately, a single lookup table that describes the relationship between current draw and charge frequency for different candela level at a fixed voltage level can be used. This approach will still be more efficient than using a single charge frequency for all the candela levels. It can be implemented without a need for input voltage information. The fixed voltage level will be established through experimentation to determine what fixed voltage level should be chosen to have the lower current draw.

Figure 7:
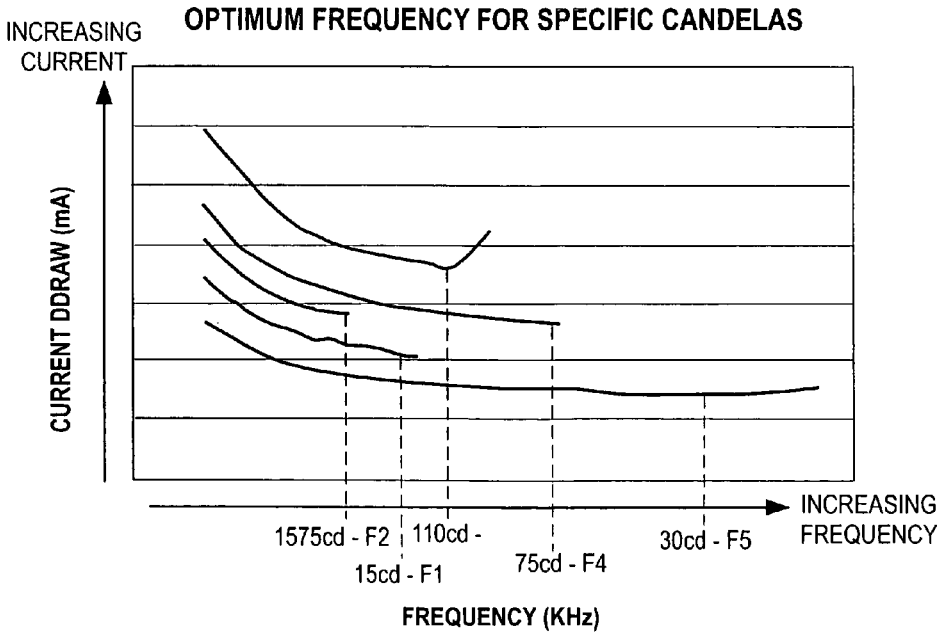
FIG. 7 is a graph that illustrates another method in accordance with the invention.

FIG. 7 illustrates one embodiment of an alternate method in accordance with the present invention. Where the voltage across the power lines 54*a* is known and substantially fixed, for example, 12 volts, and the respective strobe units need not be able to respond to various input voltages, as illustrated in the graph of FIG. 7, current minimizing charging frequencies can be established for each of a plurality of different candela outputs such as 15 candela, 15/75 candela, 30 candela, 75 candela and 110 candela. The minimal current frequency can be stored in a table, for example, in read only memory 22, which could be implemented as programmable read only memory (such as EEPROM). Instead of having to sense the input voltage in such a system, since the prestored minimal current frequencies correspond to the applied input voltage, it will only be necessary to retrieve same from memory and use the retrieved prestored frequency value to establish a charging frequency for the storage capacitor and flash tube element 30. In this embodiment, the corresponding strobe units would also exhibit a substantially minimal current draw.

It will be understood that the exact values of voltages coupled via power line 54*a* to the plurality of strobe units 54 are not a limitation of the present invention. Similarly, the characteristics of the ambient condition detector 56 as well as the characteristics of the control unit 58 are also not limitations of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A strobe unit comprising:

a housing;

a manually settable member, carried by the housing for designating one of a plurality of selectable light output parameters;

a strobe light carried by the housing;

control circuits carried by the housing, coupled to the member and the light, the control circuits, responsive to the designated light output parameter, select a predetermined minimal current charging frequency from a plurality of predetermined charging frequencies associated with the designated light output, and each selected corresponds to a minimal current draw for the respective light output.

2. A unit as in claim 1 which includes circuitry that stores the plurality of predetermined charging frequencies.

3. A unit as in claim 2 which includes a pre-stored plurality of target charging voltage values, each of which is associated with a respective one of the selectable light output parameters.

4. A unit as in claim 2 where the control circuitry senses an input voltage.

5. A strobe unit comprising:

a housing;

a manually settable member, carried by the housing for designating one of a plurality of selectable light parameters;

a strobe light carried by the housing;

control circuits carried by the housing, coupled to the member and the light, the control circuits, responsive to the designated light output parameter, select a predetermined minimal current charging frequency, associated with the designated light output, from a plurality of predetermined charging frequencies, each of which is associated with one of the selectable light output parameters, and each of which corresponds to a minimal current draw for the respective light output, and where the control circuits select the charging frequency in response to both the designated light output and a sensed input voltage.

6. A strobe unit comprising:

a housing;

a manually settable member, carried by the housing for designating one of a plurality of selectable light parameters;

a strobe light carried by the housing;

control circuits carried by the housing, coupled to the member and the light, the control circuits, responsive to the designated light output parameter, select a predetermined minimal current charging frequency, associated with the designated light output, from a plurality of predetermined charging frequencies, each of which is associated with one of the selectable light output parameters, and each of which corresponds to a minimal current draw for the respective light output, and where the control circuitry determines if a sensed input voltage comprises one of a substantially constant or a varying voltage.

7. A unit as in claim 6 which includes an electronic device that stores a plurality of target charging voltage values, each of which is associated with a respective one of the selectable light output parameters.

8. A unit as in claim 7 where the control circuits select the target charging voltage and the charging frequency in response to sensed input voltage and the designated light output.

9. A method comprising:

establishing a plurality of charging frequencies, each of which corresponds to a minimal current draw condition for a respective light output;

sensing a pre-selected desired light output;

sensing an available input voltage;

selecting a charging frequency from the plurality of charging frequencies, in response to the pre-selected light output and available input voltage;

charging a storage element with electrical energy at the selected charging frequency; and discharging the storage element and generating the desired light output.

10. A method as in claim 9 which includes storing the plurality of charging frequencies.

11. A method as in claims 9 where selecting includes retrieving a pre-stored charging frequency from the stored plurality of charging frequencies.

12. A method as in claim 9 which includes establishing a plurality of target voltage values with each value associated with a respective desired light output.

13. A method as in claim 12 where charging includes retrieving the target value associated with the pre-selected desired light output and charging the storage element to the retrieved target value.

14. A unit as in claim 9 where a plurality of target voltage values are established, each voltage value being associated with a respective desired light output.

15. A unit as in claim 14 where the target voltage value associated with a pre-selected desired light output is retrieved and the storage element is charged to the retrieved target value.

16. A strobe unit comprising:

a storage element;

a strobe light coupled to the storage element;

circuitry for establishing a plurality of selectable light outputs and a plurality of charging frequencies, each of which corresponds to a minimal current draw for a respective selected light output; and an input voltage port where, in response to a pre-selected light output and input voltage available at the port, a charging frequency is selected from the plurality of charging frequencies, the storage element is charged with electrical energy at the selected charging frequency, the storage element is discharged, and the desired light output is generated.

17. A unit as in claim 16 where the members of the plurality of charging frequencies are stored.

18. A unit as in claim 17 where a stored charging frequency is retrieved from the stored plurality of charging frequencies.

* * * * *